US007205515B2

(12) United States Patent
Kikuchi et al.

(10) Patent No.: US 7,205,515 B2
(45) Date of Patent: Apr. 17, 2007

(54) IMAGE FORMING APPARATUS

(75) Inventors: Kazuhiko Kikuchi, Yokohama (JP); Kazushige Morihara, Yokohama (JP); Satoshi Kinouchi, Tokyo (JP); Osamu Takagi, Tokyo (JP); Shin Yamauchi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/410,045

(22) Filed: Apr. 25, 2006

(65) Prior Publication Data

US 2006/0186114 A1 Aug. 24, 2006

Related U.S. Application Data

(63) Continuation of application No. 10/805,522, filed on Mar. 22, 2004, now abandoned.

(51) Int. Cl.
*H05B 6/14* (2006.01)
*G03G 15/20* (2006.01)

(52) U.S. Cl. ..... 219/619; 219/670; 219/649; 399/328; 399/330

(58) Field of Classification Search ..... 219/619, 219/670, 663–667, 649; 399/328–335
See application file for complete search history.

(56) References Cited

U.S. PATENT DOCUMENTS

| | | | |
|---|---|---|---|
| 6,026,273 | A | 2/2000 | Kinouchi et al. |
| 6,321,046 | B1 | 11/2001 | Kikuchi et al. |
| 6,377,778 | B1 | 4/2002 | Kikuchi et al. |
| 6,522,846 | B2 | 2/2003 | Kinouchi et al. |
| 2002/0186991 | A1 | 12/2002 | Watanabe et al. |
| 2002/0190060 | A1 | 12/2002 | Imai et al. |
| 2003/0152406 | A1 | 8/2003 | Terada et al. |

FOREIGN PATENT DOCUMENTS

| | | | |
|---|---|---|---|
| JP | 09-016006 | A | 1/1997 |
| JP | 10-091019 | A | 4/1998 |
| JP | 11-297462 | A | 10/1999 |
| JP | 2001-313162 | A | 11/2001 |

*Primary Examiner*—Philip H. Leung
(74) *Attorney, Agent, or Firm*—Foley and Lardner LLP

(57) ABSTRACT

In an image forming apparatus according to the present invention, a shield plate 202 which is made of a specific material and has a specific thickness is provided between an exciting coil and at least one of a first and a second magnetic field intensity measuring point P1, P2, which prevents a magnetic field of a specific magnetic field intensity or higher from leaking to the outside of the image forming apparatus or alleviates the effect of the magnetic field on the circuits in the apparatus or optionally installed devices.

8 Claims, 6 Drawing Sheets

Skin depth of each metal material at the frequency used [μm]
| | Copper | Aluminium | Iron | Nickel |
|---|---|---|---|---|
| 20kHz | 14.78 | 17.80 | 35.60 | 29.07 |
| 40kHz | 10.45 | 12.59 | 25.17 | 20.55 |
| 60kHz | 8.53 | 10.28 | 20.55 | 16.78 |
| 80kHz | 7.39 | 8.90 | 17.80 | 14.53 |
| 100kHz | 6.61 | 7.96 | 15.92 | 13.00 |
FIG. 7
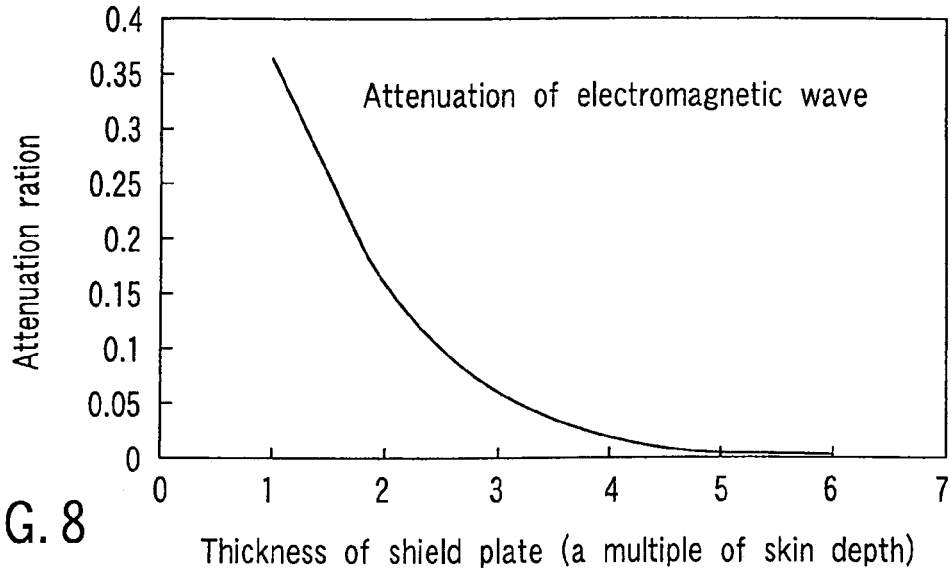
FIG. 8
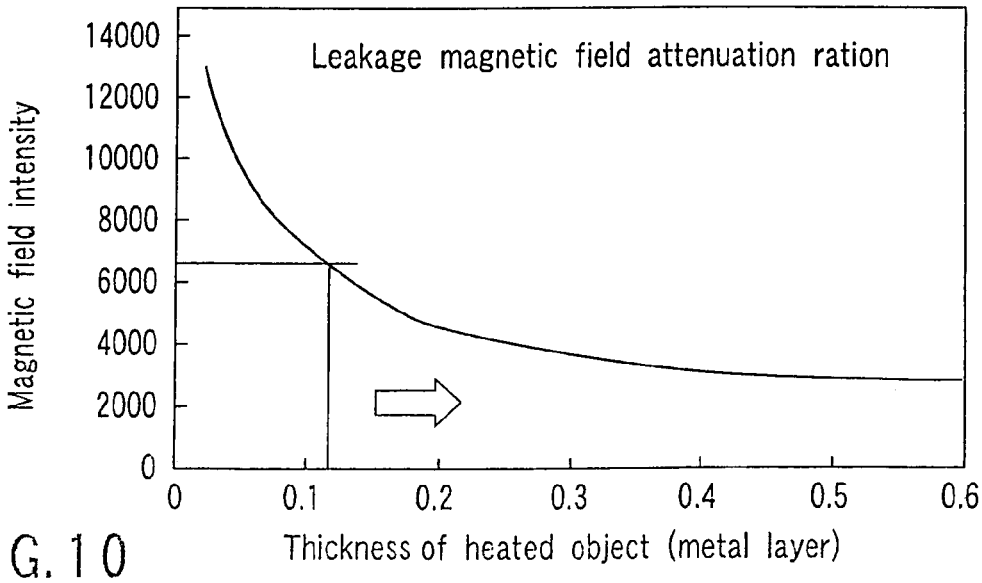
FIG. 10

IMAGE FORMING APPARATUS

The present application is a continuation of U.S. application Ser. No. 10/805,522, filed Mar. 22, 2004 now abandoned, the entire contents of which are incorporated herein by reference.

BACKGROUND OF THE INVENTION

1. Field of the Invention

This invention relates to an image forming apparatus, such as a copying machine or a printer, provided with a fixing unit which fixes a developer image on paper.

2. Description of the Related Art

In recent years, in a fixing unit installed in a copying machine using electrophotographic processes, a method using the heat generation of metal by electromagnetic induction has been put to practical use.

One known fixing unit using induction heating is such that, for example, the magnetic flux leaking from the induction coil provided outside the fixing roller is suppressed by a shield member and the heat dissipation of the induction coil is enhanced (Jpn. Pat. Appln. KOKAI Publication No. 2001-313162).

Another known induction heating fixing unit with a exciting coil outside the rotating body is such that the arrangement of a magnetic material on the opposite side of the rotating body of the exciting coil not only increases the heat generation efficiency but also prevents the magnetic field produced from the exciting coil from leaking to the adjoining parts (Jpn. Pat. Appln. KOKAI Publication No. 11-297462).

A further known induction heating fixing unit is such that an induction heating member, a film member for moving the heating member, and an exciting coil fixing member have a ferromagnetic, high-resistivity shield member, thereby preventing electromagnetic noise leaks (Jpn. Pat. Appln. KOKAI Publication No. 9-16006).

Preventing the high-frequency magnetic field generated from the coil from leaking to the outside of the fixing unit prevents the faulty operation of the other devices in the apparatus, including an optionally installed printer controller and FAX controller.

In addition, even when a magnetic field differing in intensity is generated according to the operation mode, the effect of the magnetic field on the other devices in the apparatus is reduced to a minimum.

BRIEF SUMMARY OF THE INVENTION

According to an aspect of the present invention, there is provided an image forming apparatus comprising: a heating member which includes a conductive member containing a coil for, when supplied with a voltage and current of a specific frequency, producing a magnetic field of a specific magnetic field intensity and generating heat by the magnetic field supplied from the coil; a magnetic field attenuating mechanism which is capable of attenuating the magnetic field intensity of the magnetic field passing through the mechanism; and at least one magnetic field attenuating mechanism unit which is provided between a specific magnetic field intensity measuring point and the coil.

According to another aspect of the present invention, there is provided an image forming apparatus comprising: a heating member which includes a conductive member having on its outside a coil for, when being supplied with a voltage and current of a specific frequency, producing a magnetic field of a specific magnetic field intensity and generating heat by the magnetic field supplied from the coil; a magnetic field attenuating mechanism which is capable of attenuating the magnetic field intensity of the magnetic field passing through the mechanism; and at least one unit of the magnetic field attenuating mechanism which is provided between a specific magnetic field intensity measuring point and the coil.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7 is a reference diagram to help explain a second characteristic of the shield plate applicable to the fixing unit of the present invention;

FIG. 8 is a reference diagram to help explain a third characteristic of the shield plate applicable to the fixing unit of the present invention;

FIG. 10 is a reference diagram to help explain leakage magnetic flux intensity when a shield plate applicable to the fixing unit of the present invention is not used.

DETAILED DESCRIPTION OF THE INVENTION

Hereinafter, referring to the accompanying drawings, an image forming apparatus to which an embodiment of the present invention is applied will be explained.

Figure 1:
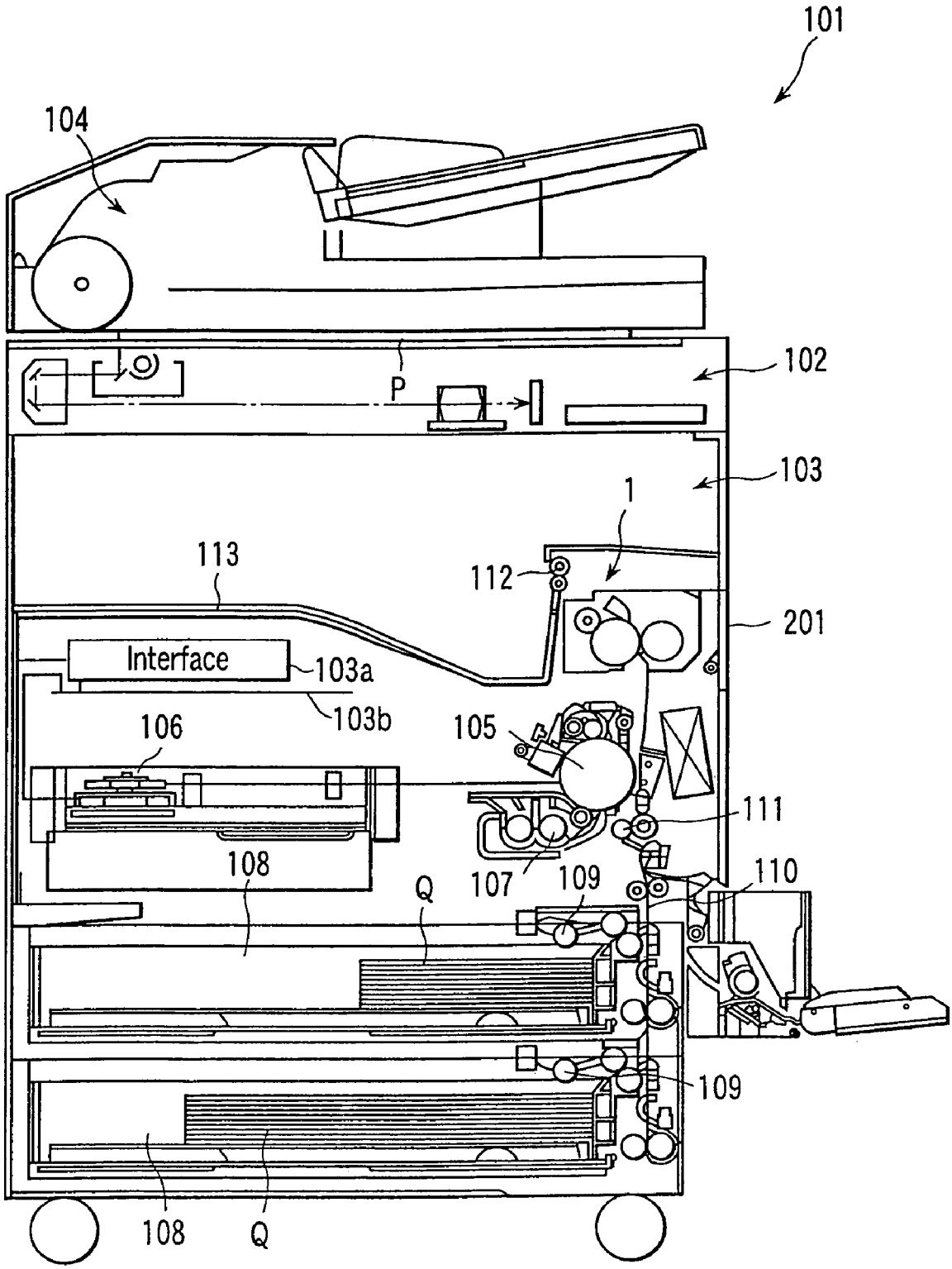
FIG. 1 is a schematic diagram to help explain an image forming apparatus to which an embodiment of the present invention is applicable.

As shown in FIG. 1, an image forming apparatus (digital copying machine) 101 comprises an image reading unit (scanner) 102 for generating an image signal by reading an object (document) P to be read or copied and an image forming section 103 for forming an image on the basis of the image signal outputted from the scanner 102. An image signal outputted from a printer board 103*b* to which an interface 103*a* is connected may be inputted to the image forming section 103.

The image forming section 103 includes a fixing unit 1, a photoreceptor drum 105, a photolithography machine 106, a developing machine 107, a sheet cassette 18, a pickup roller 109, a transport path 110, an aligning roller 111, a discharge roller 112, and a catch tray 113.

The fixing unit 1 applies heat and pressure to a sheet Q which holds a toner image, thereby setting (fixing) the melted toner image to the sheet Q. The fixing unit 1 is covered with a protective cover 201 and is therefore housed on the inside of the cover 201, which will be explained later by reference to FIG. 5.

Therefore, the sheet Q passes through the photoreceptor drum 105 and fixing unit 1 vertically in that order, thereby forming an image of the document P. The sheet Q on which the image has been formed is discharged by the discharge roller 112 to the catch tray 113 defined between the sheet cassette 108 and the scanner 102.

Figure 2:
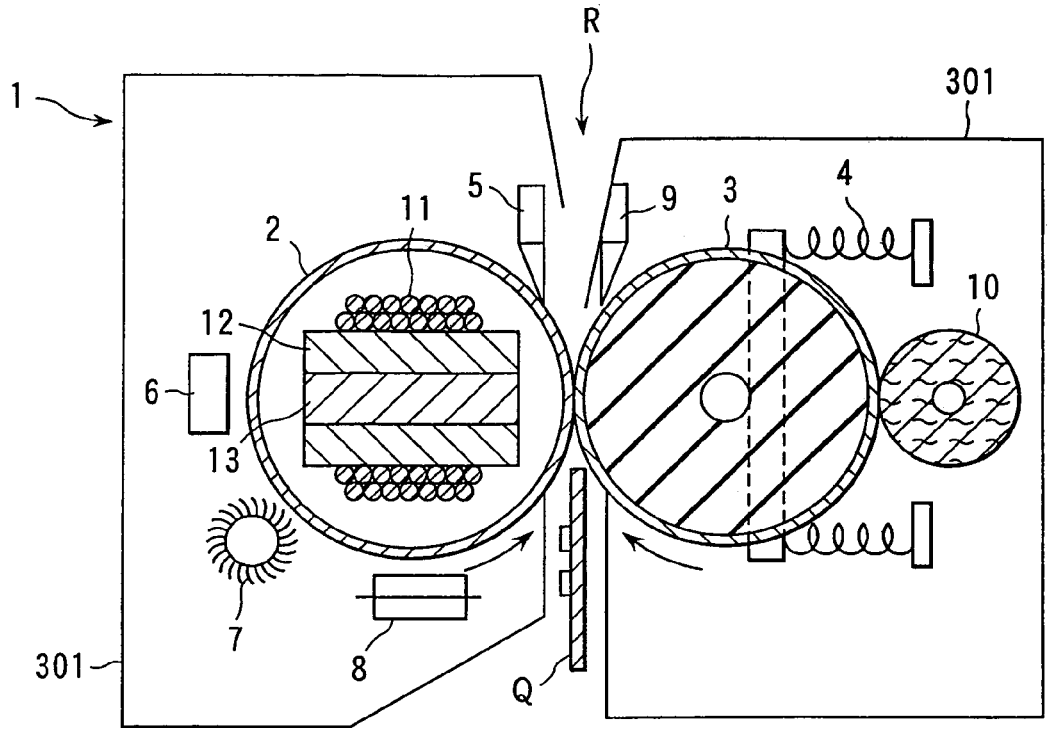
FIG. 2 is a schematic diagram to help explain a fixing unit installed in the image forming apparatus of FIG. 1.
Figure 3:
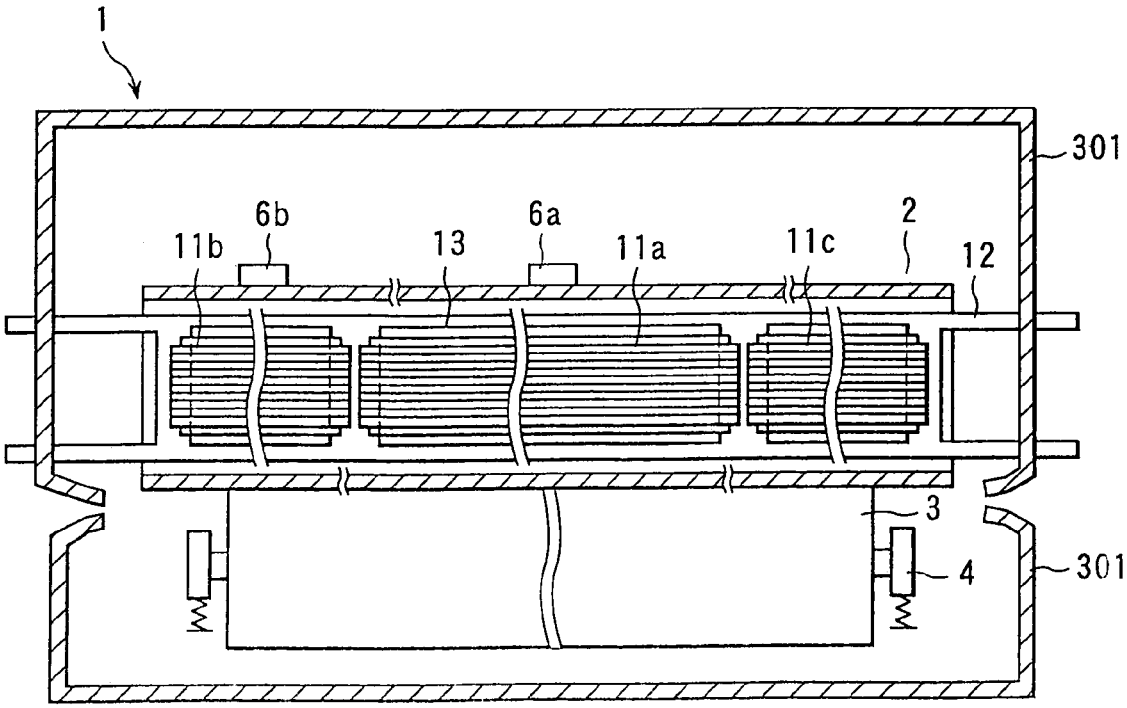
FIG. 3 is a schematic diagram to help explain an example of the arrangement of an exciting coil in the fixing unit of FIG. 2.

FIGS. 2 and 3 are schematic diagrams to help explain an example of the fixing unit used in the image forming apparatus of FIG. 1.

FIG. 2 is a schematic plan view to help explain an example of the fixing unit 1.

The fixing unit 1 includes a fixing (heating) roller 2, a press (pressure) roller 3, a pressure mechanism 4, a peeling claw 5, a temperature sensing element 6, a cleaning member 7, a heat generation abnormality sensing element 8, a peeling claw 9, a cleaning roller 10, an exciting coil 11, a coil holder 12, and a magnetic core 13.

The heating roller 2 is such that a metal hollow cylinder conductive member with a thickness of about 1 mm, preferably about 0.5 mm, is held in roller form. The conductive member of the heating roller 2 may be made of iron, stainless steel, nickel, aluminum, an alloy of stainless steel and aluminum, or the like. On the surface of the heating roller 2, a separate layer (not shown) is formed by depositing fluorocarbon resin, such as tetrafluoroethylene resin, to a specific thickness.

In the embodiment, an electroformed belt made of nickel of a thickness of h2=0.04 mm is used as the conductive member of the heating roller 2. A roller with an outside diameter of 40 mm is used for the heating roller 2 and fixing roller 3.

The pressure roller 3 is an elastic roller which is such that a rotation axis with a specific diameter is covered with silicone rubber, fluoric rubber, or the like of a specific thickness.

The pressure mechanism 4 is pressed towards the longitudinal axis of the heating roller 2 at a specific pressure. The pressure roller 3 is kept almost in parallel with the longitudinal axis of the heating roller 2.

As a result, a specific nip is formed between the two rollers.

The heat generation abnormality sensing element 8, which is, for example, a thermostat, senses a heat generation abnormality of the surface temperature of the heating roller 2 rising abnormally. When heat generation abnormality has occurred, the heat generation abnormality sensing element 8 is used to cut off the electric power supplied to the heating coil (exciting coil) explained below.

The order in which the temperature sensing elements 6*a*, 6*b*, cleaning member 7, and heat generation abnormality sensing element 8 are arranged and their locations is not limited to the order and locations shown in FIG. 2.

The peeling claw 9 for peeling the sheet Q from the pressure roller 3 and the cleaning roller 10 for removing toner adhered to the surface of the pressure roller 3 are provided on the circumference of the pressure roller 3.

The heating roller 2 includes the exciting coil 11 for supplying a specific magnetic field to the heating roller 2 composed of a conductive member, a coil holder 12 for holding the exciting coil 11, and the magnetic core 13 for increasing the flux density of the magnetic field generated from the exciting coil 11 usable to cause the heating roller 2 to generate heat.

The coil holder 12 has high heat resistance and high insulation. For example, the coil holder is made of engineering plastic, ceramic, PEEK (polyether ether ketone) material, phenol material, unsaturated polyester, or the like.

The magnetic core 13 is made mainly of a material with low losses at high frequencies, such as a dust core. The exciting coil 11 may be an air-core coil without a magnetic core material.

FIG. 3 is a schematic diagram of the fixing unit 1 of FIG. 2 viewed from the direction shown by the arrow R, with a part of the cover broken away.

The exciting coil 11 is composed of a first coil 11*a* located almost in the middle in the longitudinal direction of the heating roller 2, and a second coil 11*b* and a third coil 11*c* located near at both ends in the longitudinal direction of the heating roller 2, that is, at both ends of the first coil 11*a*.

The first coil 11*a* (center coil) is so formed that it has such a length as, when, for example, a A4-size sheet is conveyed in such a manner that its short side is in parallel with the longitudinal axis of the heating roller 2, enables the width of the sheet contacting the outer circumferential surface of the roller 2 to be heated.

The second and third coils 11*b*, 11*c* (end coils) are a single coil electrically and connected in series. When they are arranged in line with the first coil 11*a* as shown in FIG. 3, the longitudinal length of them is a little longer than the short side of a A3-size sheet.

The first, second, and third coils 11*a*, 11*b*, and 11*c* are made of a wire material whose cross-sectional area is equivalent to, for example, a 1-mm copper material. A stranded wire formed by stranding a plurality of thin wire materials with no insulating film, a litz wire formed by stranding a specific number of wire materials each covered with insulating material, or the like may be used as the wire material. Each of the coils 11*a*, 11*b*, and 11*c* can be formed by an arbitrary winding method. They are wound around the coil holder 12.

A voltage and current of a specific resonance frequency are supplied to each coil. The coil then applies a magnetic field of a specific magnetic field intensity to a specific part of the heating roller 2, thereby generating a magnetic flux and an eddy current in the heating roller 2. The eddy current and heating roller resistance produce Joule heat, thereby heating the heating roller 2.

Therefore, the second and third coils 11*b*, 11*c* are helpful in heating the vicinities of both ends of the heating roller 2, whereas the first coil 11*a* can heat the middle in the longitudinal direction of the heating roller 2.

The center coil and end coils may be divided, for example, almost in the middle of the heating roller 2 into two. Alternatively, for example, when a coil (not shown) is provided for the pressure roller 3, the first coil 11*a* (center coil) may be provided on the heating roller 2 side and the second and third coils 11*b*, 11*c* (end coils) may be provided on the pressure roller 3 side.

A wire material with a specific cross-sectional area is used for the first, second, and third coils 11*a*, 11*b*, and 11*c*. Each of the first, second and third coils has a specific number of turns so as to resonate at its inherent resonance frequency, thereby maximizing its resistance value. They are designed to produce almost the same outputs. The output of each of the coils produces a magnetic flux capable of producing an eddy current to cause the heating roller 2 (or pressure roller 3) to generate heat. The output of the coils is managed by controlling the power supplied to the coils.

Figure 4:
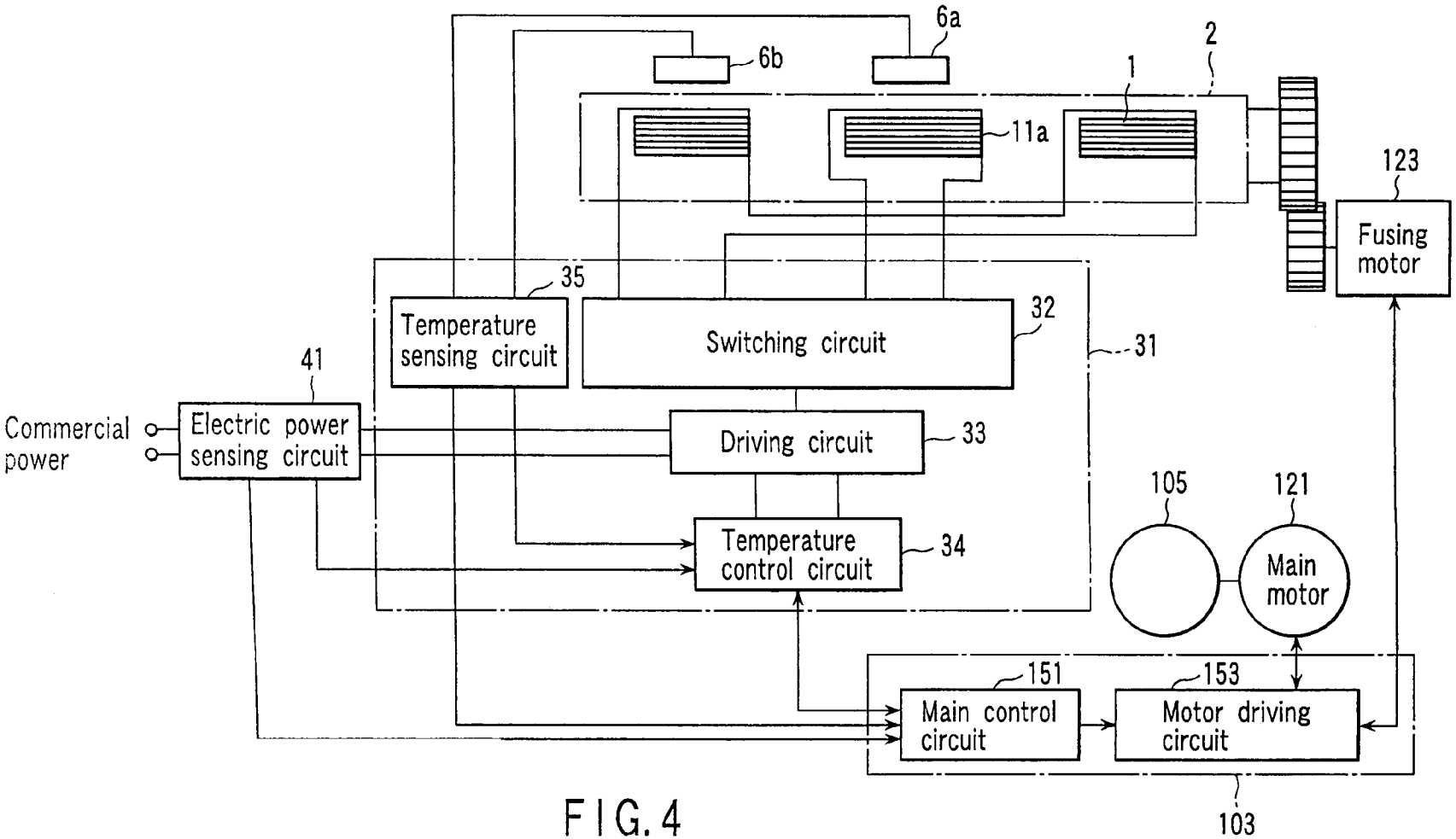
FIG. 4 is a schematic diagram to help explain the fixing unit shown in FIGS. 2 and 3 and the control system of the image forming apparatus of FIG. 1.

FIG. 4 is a diagram to help explain a driving circuit for operating the fixing unit 1 shown in FIGS. 2 and 3 and a control circuit for operating the image forming apparatus into which the fixing unit 1 is incorporated.

The heating roller 2 of the fixing unit 1 houses the exciting coil 1 (coils 11*a*, 11*b*, 11*c*) for producing an eddy current in the conductive material of the heating roller 2 as described above and thereby generating heat.

Connected to the exciting coil 11 is an exciting unit 31 for supplying high-frequency outputs of a specific frequency (current and voltage) to each coil of the exciting coil 11.

The exciting unit 31 includes a switching circuit 32 capable of outputting high-frequency outputs to be supplied to the individual coils 11*a*, 11*b*, 11*c* and a driving circuit 33 for inputting a specific control signal (the number of times of switching) to the switching circuit 32 to supply a specific output to the respective coils.

The switching circuit 32 is capable of, for example, connecting all of the coils 11*a*, 11*b*, 11*c* in series, or connecting the coils 11*b*, 11*c* in series and then connecting the resulting series connection in parallel with the coil 11*a*, or connecting all of the coils 11*a*, 11*b*, 11*c* in parallel. That is, the switching circuit 32 also functions as a selector unit capable of setting a series connection or a parallel connection between the individual coils 11*a*, 11*b*, 11*c*.

A direct-current voltage obtained by rectifying a received commercial power alternating voltage with a rectifier (not shown) is supplied via the driving circuit 33 to the switching circuit 32.

At this time, the driving circuit 33 instructs the switching circuit 32 of which of the high-frequency outputs is to be outputted by the switching circuit 32, or the time that the switching elements (not shown) are to be turned on for the respective coils 11*a*, 11*b*, 11*c* to output the coil outputs, specific heating power, or the number of times (driving frequency) the switching element is turned on during a unit time.

In the embodiment, the driving circuit 33 instructs the switching circuit 32 of a first frequency f1 to be supplied to the coil 11*a* and a second frequency f2 to be supplied to the coil 11*b*. In other words, the magnitude of the magnetic flux, or the heating power, outputted from each coil to produce an eddy current in the heating roller 2 to raise the temperature of the heating roller 2 can be set to an arbitrary magnitude by controlling the driving circuit 33 to change the outputs from the switching circuit 32 to the respective coils.

The heating power is generally managed in values in the form of the amount of power consumed by each coil. Hereinafter, explanation will be given regarding the coil output (power consumption) of each coil just as an electric power inputted to a coil and the frequency of the power consumption as the using frequency.

The electric power supplied from the rectifying circuit to an arbitrary one or all of the coils is continually monitored by an electric power sensing circuit 41 provided in a specific place, such as between the rectifying circuit and the input terminal of a commercial power supply, between the rectifying circuit and the driving circuit 33, or between the driving circuit 33 and the switching circuit 32.

The result of the monitoring by the electric power sensing circuit 41 is fed back to the driving circuit 33 with a specific timing. To make it possible to sense the burnout or the like of the driving circuit 33, the output of the electric power sensing circuit 41 is also inputted to a main control unit 151 on the image forming section 103 side.

The main control unit 151 is connected to a motor driving circuit 153.

The motor driving circuit 153 is connected to a main motor 121 for supplying driving force to a specific member of the image forming section 103, such as the photoreceptor drum 105, and the fuser motor 123 for rotating the heating roller 2.

In a case where electric power of a specific frequency is supplied to a first coil and a second coil differing in a coil constant, such as inductance L (the inductance of the second coil is lower than that of the first coil), when an independent switching circuit is provided, an attempt to control the output of the second coil in the same range as that of the first coil requires the second coil to have the frequency range of about 30 kHz to 40 kHz, provided that, for example, the frequency range required to control the output of the first coil in the range of 1 kW to 600 W is from 20 kHZ to 30 kHz.

That is, when the coil outputs of the coils differing in inductance are changed, operating the individual coils independently results in a small variation in the frequency.

In contrast, in a case where the first coil with a specific inductance and the second coil with a lower inductance than that of the first coil are connected to a single switching circuit and electric power of a specific frequency is supplied, for example, when the output of the first coil is 900 W and the output of the second coil is 1.1 kW at a frequency of 20 kHz, the output of the first oil is changed to 500 W and the output of the second coil is changed to about 0.9 kW at a frequency of 30 kHz. In addition, when the frequency is changed to 40 kHz, the output of the first coil is lowered to about 200 W, whereas the output of the second coil is kept at about 500 W.

Next, the relationship between the frequency of electric power supplied to each coil and the coil output will be explained.

For example, electric power supplied to each of the coils 11*a*, 11*b*, 11*c* can be changed in the range of, for example, 700 W to 1.5 kW arbitrarily in terms of the amount of power consumed by the coil. As is generally known, the amount of current flowing in any one of the coils 11*a*, 11*b*, 11*c* of the exciting coil 11 is determined by setting a frequency applied to the coil, an impedance, and so forth.

For example, in a case where electric power differing only in frequency is supplied, even when the current value is 10 mA, the inductance and pure resistance are changed as follows: inductance L=24.6 μH, pure resistance R=1,2Ω at 25 kHz, inductance L=18.69 μH, pure resistance R=3.5Ω at 100 kHz, and inductance L=15.1 μH, pure resistance R=4, 9Ω at 1 MHz. Therefore, the higher the frequency, the larger the impedance.

Figure 5:
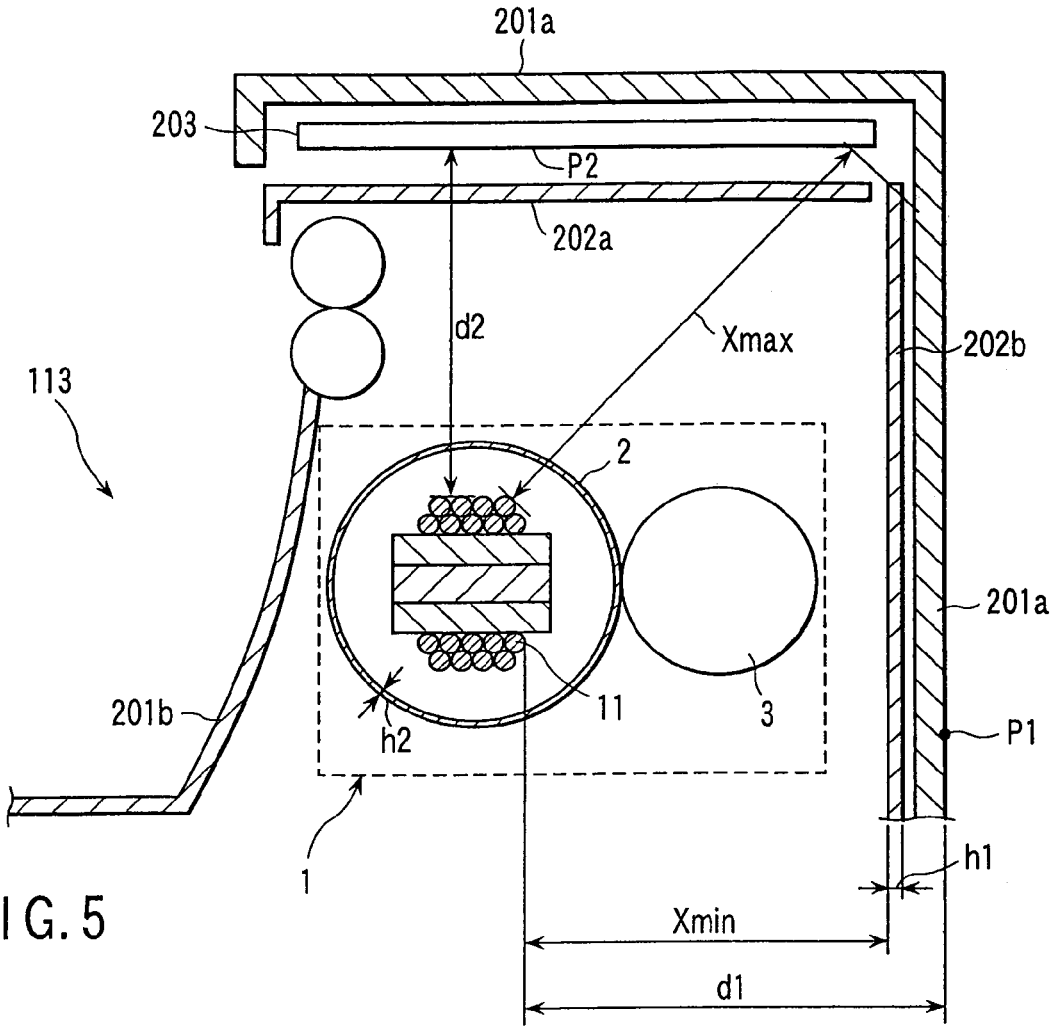
FIG. 5 is a schematic diagram to help explain an example of the fixing unit applicable to the image forming apparatus of FIG. 1.

FIG. 5 is a view of the peripheral part of the fixing unit provided in the image forming apparatus of FIG. 1, showing the positional relationship between the outside wall of the image forming apparatus 101 and the fixing unit.

As shown in FIG. 5, the fixing unit 1 is provided inside the image forming apparatus 101, that is, inside protective covers 201*a*, 201*b*. Around the fixing unit 1, for example, an optional specific circuit 203 is provided.

The first magnetic field intensity measuring point is within the protective cover 201*a*. The first magnetic field intensity measuring point P1 is a specific point within the protective cover 201*a* that is the closest to the exciting coil 11 and has the shortest distance d1 (including the thickness of the protective cover 201*a*) to the exciting coil 11.

The second magnetic field measuring point P2 is within the circuit 203. The second magnetic field intensity measuring point P2 is a specific point which is the closest to the exciting coil 11 and has the shortest distance d2, within the circuit 203.

Between the first magnetic field intensity measuring point P1 and the exciting coil 11, there are provided magnetic field attenuating mechanisms (shield plates) 202*a*, 202*b* capable of attenuating the intensity of the magnetic field passing between them to a specific intensity or less. In addition, between the second magnetic field intensity measuring point P2 and the exciting coil 11, the shield plate 202*a* is provided. The magnetic field intensity attenuating mechanisms may be not only constructed from a plurality of members but also formed integrally. The shield plates 202*s*, 202*b* are represented simply as shield plate 202 in the explanation below.

That is, the shield plate 202 is provided between the exciting coil 11 and the specific points in the image forming apparatus 101 or on its surface, such as the first and second magnetic field intensity points P1, P2.

The shield plate 202 has a minimum distance of Xmin and a maximum distance of Xmax from the exciting coil 11.

(1) The shield plate 202 has a first characteristic determined by the distance from the exciting coil 11. The shield plate 202 is provided in a specific position in the distance range of Xmax to Xmin (mm) from the exciting coil 11 of the fixing unit 1 explained below.

(2) The shield plate 202, which has a second characteristic determined by the skin depth of the conductor, is made of a specific material explained below.

(3) The shield plate 202, which has a third characteristic determined by the frequency of the voltage and current supplied to the exciting coil 11 and the skin depth of the conductor used, has a specific thickness explained below.

As determined in "Radio Wave Protection Standard" or a public level standard known in "International Committee for Nonionizing Radiation Protection (ICNIRP)," when a frequency of f (kHz) in the range of $0.8<f<150$ is used, the application of a magnetic field with a magnetic field intensity of 6.25 μT or more to a circuit or the like can cause a malfunction in the circuit. Therefore, when a circuit is provided in the vicinity of a magnetic-field-generating circuit, the magnetic field intensity applied to the circuit has to be equal to or lower than 6.25 μT.

Therefore, the exciting coil 11 has to be provided in such a position as has a magnetic field intensity of 6.25 μT or less at least at one of the first and second magnetic field intensity measuring points P1, P2 as a result of the intensity of the generated magnetic field being limited when passing through.

Since the catch tray 113 is formed on the left side of the protective cover 201*b*, the effect of the magnetic field need not be taken into account. The protective covers 201*a*, 201*b* constitute the protective cover 201 of the image forming apparatus 101. Although they are divided and indicated by reference numerals for the sake of explanation, they may be formed integrally out of the same material.

(1) An example of the position where the shield plate 202 is provided will be explained by reference to FIG. 6.

Figure 6:
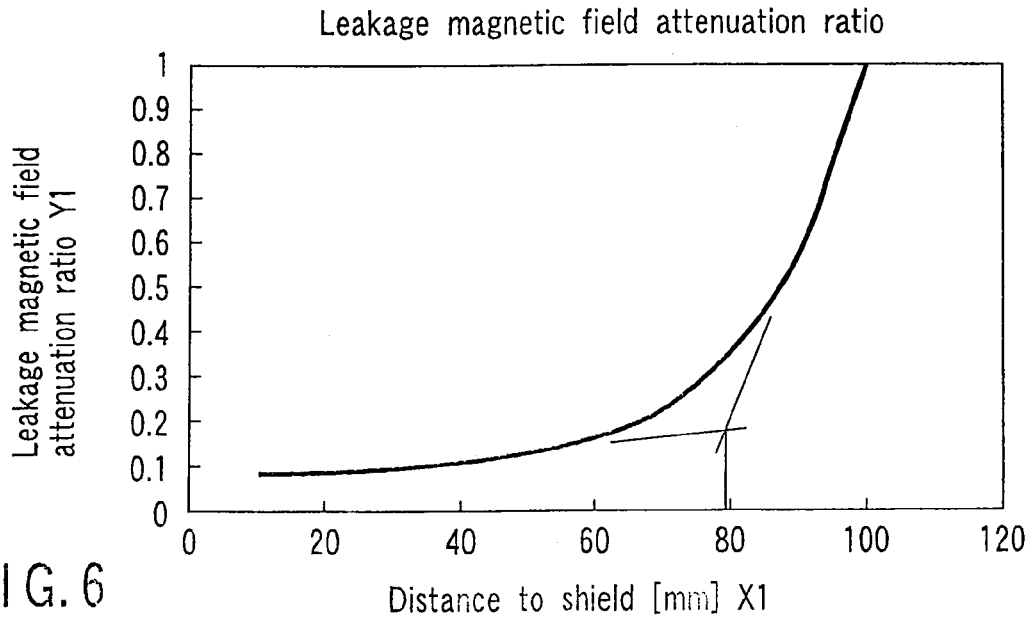
FIG. 6 is a reference diagram to help explain a first characteristic of a shield plate applicable to a fixing unit of the present invention.

FIG. 6 shows the relationship between the distance X1 (mm) between a specific point on the shield plate 202 and the exciting coil 11 and leakage magnetic field attenuation ratio Y1, with the abscissa axis as distance X1 and the ordinate axis as leakage magnetic field attenuation ratio Y1. The distance X1 is the maximum distance Xmax in, for example, FIG. 5.

The leakage magnetic field attenuation ratio Y1 is the ratio of magnetic fields capable of passing through the shield plate 202 and attenuating. The leakage magnetic field attenuation ratio Y1 is defined as the value obtained by dividing the intensity of a magnetic field passed through the shield plate 202 when the shield plate 202 is used by the magnetic field intensity at the surface of the protective cover 201*a* when the shield plate 202 is not used.

Since the magnetic field intensity is inversely proportional to the square of the distance, if the minimum distance from the surface of the exciting coil 11 to the first magnetic field intensity measuring point P1 is d1, the distance from the first magnetic field intensity measuring point P1 to the measuring instrument is D1, and the magnetic field intensity measured by the measuring instrument is T1, the magnetic field intensity t1 at the first magnetic field intensity measuring point P1 is expressed as:

$$t1 = \frac{T1\,(D1 + d1^2)}{d1^2} \qquad \text{(equation 1)}$$

As seen from FIG. 6, as the shield plate 202 is farther away from the exciting coil 11, the leakage magnetic field attenuation ratio Y1 increases. This is because the increase of the distance X1 leads to the occurrence of a leakage magnetic field due to diffraction.

Specifically, in and around a place where the distance between the shield plate 202 and the exciting coil 11 is 100 mm, the leakage magnetic field attenuation ratio Y1 is 1, which means that the shield plate 202 has not achieved the function of preventing the magnetic field from the exciting coil 11 from leaking to the opposite side beyond the shield plate 202 (or the shielding effect). In addition, for X1=90 mm or more, the leakage magnetic field attenuation ratio Y1 is about 0.7 or more, which means that the effect is small for the cost of providing the shield plate 202.

However, when the distance between the shield plate 202 and the exciting coil 11 is 60 mm or less, the leaking magnetic field can be limited effectively. In addition, for X1=80 mm or less, the leakage magnetic field attenuation ratio Y1 is about 0.35 or less and therefore the magnetic flux intensity is suppressed to about ⅓ of the magnetic flux intensity near a place with X1=100 mm.

Therefore, in the embodiment, it is desirable that the shield plate 202 be provided in a place whose distance X1 from the first magnetic field intensity measuring point P1 is 80 mm or less.

Since the shield plate 202 is close to the exciting coil 11, an eddy current can be generated in the metal material of the shield plate 202, and therefore generate heat, it is desirable that the shield plate 202 be separated by a specific distance (e.g., 5 mm) or more from the exciting coil 11.

It goes without saying that the explanation of the first magnetic field intensity measuring point P1 holds true for the second magnetic field intensity measuring point P2.

(2) Next, an example of the material of which the shield plate 202 is made will be explained by reference to FIG. 7.

FIG. 7 shows the relationship between copper, aluminum, iron, and nickel core metal materials (conductors) and the skin depth at each of the frequencies used.

The skin depth is determined according to the material and the using frequency. The skin depth is defined as the distance (or the length in the thickness direction) at which the incident magnetic field is attenuated to 1/e (≈1/2.718).

Specifically, if the using frequency is f, the permeability of the conductor is μ, and the conductivity is σ, the skin depth δ [m] is expressed as:

$$\delta = \sqrt{\frac{1}{\pi f \mu \sigma}} \quad \text{(equation 2)}$$

The relationship between the metal materials and the frequencies used is shown in FIG. 7.

As seen from FIG. 7, at the same frequency used, the skin depth δ becomes greater in the order of copper<aluminum<nickel<iron. In addition, with the same metal material, the lower the frequency used, the greater the skin depth δ.

The effect of reducing the passing magnetic field, that is, the shielding effect, becomes greater as the skin depth decreases.

Therefore, a greater shielding effect can be expected of aluminum or copper of a smaller thickness than nickel, iron, or the like.

Aluminum or an alloy of aluminum and iron may be used, taking cost and weight factors into account.

(3) Next, an example of the thickness of the shield plate 202 will be explained by reference to FIG. 8.

FIG. 8 shows the relationship between the plate thickness of the shield plate 202 and the magnetic field intensity attenuation ratio. The plate thickness on the abscissa axis is represented by a multiple of the skin depth in a relative value, because of a difference in the skin effect due to the material and the frequency used.

As explained above, the skin depth is defined as the distance (or the length in the thickness direction) at which the incident magnetic field is attenuated to 1/e (≈1/2.718).

Therefore, the magnetic field intensity at each of the first and second magnetic field intensity measuring points P1, P2 is attenuated effectively when the generated magnetic field passes through the shield plate 202 with a specific skin depth.

As seen from FIG. 8, securing the thickness defined as five times or more the skin depth according to the material of the conductor causes the magnetic field intensity at the surface of the protective cover 201*a* to be attenuated efficiently.

As shown in FIGS. 2 to 5, the exciting coil 11 is provided inside the heating roller 2 made of the conductive material. That is, the conductive member as the heating roller 2 and the shield plate 202 are provided between the exciting coil 11 and the first magnetic field intensity measuring point P1 (protective cover 201*a*) or between the exciting coil 11 and the second magnetic field intensity measuring point P2 (circuit 203). Therefore, the conductive member of the heating roller 2 has the same shielding effect as the shield plate 202.

Accordingly, as shown in FIG. 5, if the skin depth of the shield plate 202 is δ1, its thickness is h1, and the skin depth of the conductive member of the heating roller 2 is δ2, and its thickness is h2, the following expression holds:

$$\frac{h1}{\delta 1} + \frac{h2}{\delta 2} \geqq 5 \quad \text{(equation 3)}$$

Therefore, use of the shield plate 202 satisfying equation 3 causes the magnetic field intensity at each of the first and second magnetic field intensity measuring points P1, P2 to be attenuated efficiently. Since the attenuation of the magnetic field intensity at the second magnetic field intensity measuring point P2 decreases the intensity of the magnetic field applied to the circuit 203 (including an optional device), the malfunction of the peripheral devices can be improved.

When the generated magnetic field intensity is the highest, for example, when the power consumption of the coil at the time of warm-up is the largest (e.g. 1300 W), the frequency is 20 to 25 kHz.

As the shield plate 202 satisfying the first to third characteristics (1) to (3), it is desirable in the embodiment that (1) the shield plate be provided at a distance X1 of 80 mm or less from the surface of the exciting coil 11, that (2) the shield plate be made of aluminum, and that (3) the thickness h1 be at least 0.065 mm or more. (3) the thickness h1 can be calculated by substituting the skin depth and thickness at a using frequency of 20 kHz into equation 3, since the conductive material used in the embodiment is made of nickel with a thickness of h2=0.04 mm and the shield plate 202 is made of aluminum with a thickness of h1. As described above, since the thickness h1 of the shield plate 202 is determined by substituting into equation 3 the skin depth at a using frequency of 20 kHz, that is, the frequency of the power supplied to the exciting coil to generate a magnetic field of the highest magnetic field intensity, the magnetic field intensity of at least one of the first and second magnetic field intensity measuring points P1, P2 can be made equal to or lower than 6.25 μT.

As known from "Method of checking conformance to the Radio Wave Protection Standard (ARIBRT-11)," the range where the effect on the human body having the measuring instrument or the nearby metals or the like is alleviated is such that the distance from the measuring instrument is 20 cm or more away from every object in the case of a radiation source of a frequency of 300 MHz or more. While this range was being kept, the magnetic field was measured using a Combinover MPR-II (frequency range of 2 k to 400 kHz).

Since the exciting coil 11 might generate harmonic magnetic fields according to the frequency of the voltage and current applied (the using frequency), it is desirable that the frequency range of the measuring instrument to be used be at least five times or more as high as the using frequency.

The verification using the above-explained magnetic field measuring method has shown that, when the shield plate 202 which (1) was provided at a distance X1 of 50 mm from the surface of the exciting coil 11, (2) was made of aluminum, and (3) of a thickness of h1=0.25 mm was used, the intensity of the magnetic field leaking to the outside of the fixing unit 1 was in such a range as had no effect on the circuit 203.

As described above, meeting all of the first to third characteristics (1) to (3) enables a much greater shielding effect to be expected. It goes without saying that fulfilling at least one of the characteristics enables a shielding effect to be obtained.

Figure 9:
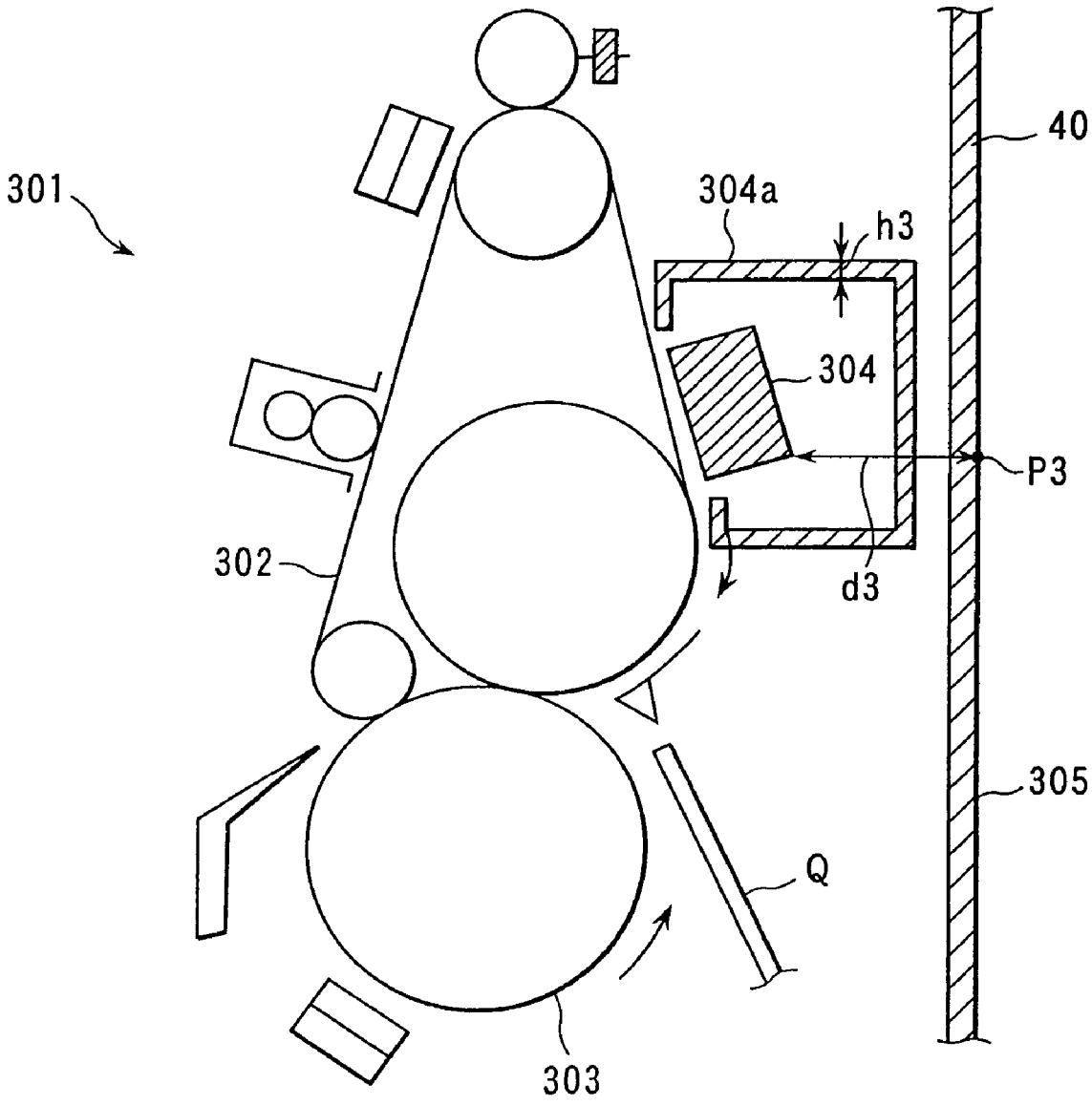
FIG. 9 is a schematic diagram to help explain another example of the fixing unit applicable to the image forming apparatus of FIG. 1.

FIG. 9 shows another example of the induction heating fixing unit applicable to the image forming apparatus 101 of the present invention.

As shown in FIG. 9, a fixing unit 301 includes a conductive film 302, a pressure roller 303, an exciting coil 304, and a shield plate 304*a*. Although not shown, the fixing unit 301 is installed in an image forming apparatus having the same function as that of the image forming apparatus of FIG. 1, that is, inside an protective cover 305.

A third magnetic field intensity measuring point P3 is within the protective cover 305. The magnetic field intensity measuring point P3 is a specific point which is the closest to the exciting coil 11 and has the shortest distance d3 to the exciting coil 11 (including the thickness of the protective cover 305).

The conductive film 302, which is an endless belt made of metal, such as nickel or stainless steel of several tens of micrometers in thickness, is moved in the direction shown by the arrow by a roller member provided in a specific inside position.

The pressure roller 303 applies a specific pressure to the conductive film 302, thereby forming a nip with a specific width.

The exciting coil 304, which is provided in a specific position outside the conductive film 302, applies a specific magnetic field to the outer circumferential surface of the conductive film 302.

The shield plate 304*a* is provided between the exciting coil 304 and the third magnetic field intensity measuring point P3 (protective cover 405). As explained later, the shield plate 304*a* is composed of a conductor whose thickness is h3 and whose skin depth is δ3.

Only the part of the magnetic field generated from the exciting coil 404 which has passed through the shield plate 304*a* is attenuated. Therefore, the thickness and material of the shield 304*a* are determined by the following expression:

$$\frac{h3}{\delta 3} \geqq 5 \qquad \text{(equation 4)}$$

That is, the shield 304*a* made of a material with the thickness h3 and skin depth δ3 meeting expression 4 is applicable to the present invention.

For example, when aluminum is used as the material for the shield plate 304*a*, it is desirable that the thickness h3 be equal to or more than 0.089 mm, five times the skin depth of 17.8 μm at a using frequency of 20 kHz at which the maximum magnetic field of FIG. 7 is generated. As described above, the thickness h3 of the shield plate 304*a* is determined by substituting into equation 4 the skin depth at a using frequency of 20 kHz, or at the frequency of the power supplied to the exciting coil to generate a magnetic field of the maximum magnetic field intensity, which enables the magnetic field intensity at the third magnetic field intensity measuring point P3 to be made 6.25 μT or less in the fixing unit being used.

An example of suppressing the leakage magnetic field by changing the thickness of the conductive member formed into a roller shape of the heating roller 2 in the fixing unit of FIG. 2 without the shield plate 202 will be explained by reference to FIG. 10 in comparison with the present invention.

FIG. 10 shows the relationship between the thickness (abscissa axis) of the conductive member of the heating roller 2 and the magnetic field intensity (ordinate axis) at a specific magnetic field intensity measuring point, for example, at the surface of the protective cover in the fixing unit surrounded with only the protective cover of the image forming apparatus. A shield plate is not provided between the fixing unit and the magnetic field intensity measuring point.

Therefore, in the fixing unit using no shield plate, the exciting coil is covered and the intensity of the passing magnetic field is decreased using the conductive member of the heating roller of the fixing unit provided between the exciting coil and the protective cover of the image forming apparatus. In this way, the magnetic field intensity at the surface of the protective cover has to be made 6.25 μT or less.

That is, to reduce the leakage magnetic field intensity to 6.25 μT or less, a conductive material whose thickness is 0.12 mm or more must be used as shown in FIG. 10.

However, the following problem arises: the thicker the conductive member, the longer the time required for the heating roller 2 to rise to the required temperature. For example, at the time of warm-up, it is desirable that the required temperature (target temperature) be reached within 10 seconds. In addition, to secure the required nip width, a specific flexibility is required. Thus, it is desirable that the conductive member be thinner. For example, preferably, the conductive member is 40 to 60 μm or less in thickness.

As described above, with the present invention, providing the shield plate 202 of the specific thickness and material in the specific position prevents a magnetic field of a specific magnetic field intensity or higher from leaking to the outside, which alleviates the effect of the magnetic field on the circuits installed in the apparatus, such as the circuit 203, or optionally installed units (including a printer controller and FAX controller). The invention may be applied to apparatuses other than those explained in the above embodiments.

In addition, when the fixing protective cover 301 of the fixing unit formed integrally with the fixing unit as shown in FIGS. 2 and 3 is used, the shield plate can be made thinner, taking into account the shielding effect of the member provided between the exciting coil and the protective cover of the image forming apparatus, as explained by using equation 3. That is, the value obtained by dividing the thickness of the fixing unit protective cover by the skin depth of the constituting material is further added to the left side of equation 3. If the total of the left side is 5 or less, the expression holds.

What is claimed is:

1. An image forming apparatus comprising:

a heating member which includes a conductive member containing a coil for, when supplied with a voltage and current of a specific frequency, producing a magnetic field of a specific magnetic field intensity and generating heat by the magnetic field supplied from the coil;

a cover which covers the heating member housed inside the image forming apparatus; and a magnetic field attenuating member which is placed between the heating member and the cover, and which is capable of attenuating the magnetic field intensity of the magnetic field passing through the magnetic field attenuating member, wherein the magnetic field attenuating member has a thickness of h1 and includes a material whose skin depth is δ1, h1 and δ1 having the following relationship:

$$\frac{h1}{\delta 1} \geq 5.$$

2. The image forming apparatus according to claim 1, wherein the skin depth δ1 is determined according to the frequency of the power supplied to the coil to generate a magnetic field of the highest magnetic field intensity.

3. The image forming apparatus according to claim 1, wherein the magnetic field attenuating member is made of aluminum or an aluminum alloy and has a thickness of 0.1 mm or more.

4. The image forming apparatus according to claim 1, wherein the distance between the magnetic field attenuating member and the coil is 80 mm or less.

5. An image forming apparatus comprising:

a heating member which includes a conductive member having on its outside a coil for, when supplied with a voltage and current of a specific frequency, producing a magnetic field of a specific magnetic field intensity and generating heat by the magnetic field supplied from the coil;

a cover which covers the heating member housed inside the image forming apparatus;

a circuit which is housed in the cover; and a magnetic field attenuating member which is placed between the heating member and the circuit and which is capable of attenuating the magnetic field intensity of the magnetic field passing through the magnetic field attenuating member, wherein the magnetic field attenuating member has a thickness of h1 and includes a material whose skin depth is δ1, h1 and δ1 having the following relationship:

$$\frac{h1}{\delta 1} \geq 5.$$

6. The image forming apparatus according to claim 5, wherein the skin depth δ1 is determined according to the frequency of the power supplied to the coil to generate a magnetic field of the highest magnetic field intensity.

7. The image forming apparatus according to claim 5, wherein the magnetic field attenuating member is made of aluminum or an aluminum alloy and has a thickness of 0.1 mm or more.

8. The image forming apparatus according to claim 5, wherein the distance between the magnetic field attenuating member and the coil is 80 mm or less.

* * * * *